US007248812B2

(12) United States Patent
Tombs

(10) Patent No.: US 7,248,812 B2
(45) Date of Patent: Jul. 24, 2007

(54) CLEANING MEMBER

(75) Inventor: Thomas N. Tombs, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 199 days.

(21) Appl. No.: 11/037,588

(22) Filed: Jan. 18, 2005

(65) Prior Publication Data

US 2005/0163527 A1 Jul. 28, 2005

Related U.S. Application Data

(60) Provisional application No. 60/539,224, filed on Jan. 26, 2004.

(51) Int. Cl.
*G03G 21/00* (2006.01)

(52) U.S. Cl. ..... 399/98

(58) Field of Classification Search ..... 399/98, 399/99, 357, 123

See application file for complete search history.

(56) References Cited

U.S. PATENT DOCUMENTS 3,706,108 A * 12/1972 Taylor
4,264,190 A * 4/1981 Tsuda et al. ..... 399/123
5,081,505 A * 1/1992 Ziegelmuller et al.
5,689,769 A * 11/1997 Appel et al. ..... 399/98
6,009,301 A * 12/1999 Maher et al.

FOREIGN PATENT DOCUMENTS

JP 01056551 A * 3/1989
JP 02208686 A * 8/1990

* cited by examiner

*Primary Examiner*—Susan Lee
(74) *Attorney, Agent, or Firm*—Lawrence P. Kessler

(57) ABSTRACT

A cleaning member for mounting around a support in an electrophotographic machine, the support being located peripherally adjacent at least one electrophotographic process device having a surface cleanable by the cleaning member, the cleaning member including a substrate supporting a cleaning agency. The cleaning member is activatable to clean via motion, which can include longitudinal movement and/or rotary movement around the support's longitudinal axis. The cleaning agency can include one or more cleaning agents selected from the following categories: brush, pad, blade, woven material, fabric, cloth, rubber, sponge, and foam. A surface cleanable by the cleaning member can be located on one or more of the following: lens array of a LED writer, charger grid, corona wire, blade, erase lamp, developer pickup scavenger device, densitometer or electrometer sensor, or retractable rotatable process device adjacent the support.

16 Claims, 7 Drawing Sheets

CLEANING MEMBER

This application claims the benefit of U.S. Provisional Application No. 60/539,224, filed Jan. 26, 2004.

FIELD OF THE INVENTION

The invention relates to electrophotography and to electrophotographic cleaning apparatus, and in particular to a removable cleaning sleeve temporarily mountable on a roller for purpose of cleaning one or more process devices peripherally adjacent the roller.

BACKGROUND OF THE INVENTION

It is well known that certain surfaces of components included within an electrophotographic machine are susceptible to contamination by airborne contaminants. These airborne contaminants, including airborne particulates, fibers, aerosols, or chemical compounds, are typically generated as a result of operating the machine. Contamination tends to gradually accumulate on such surfaces so that periodic cleanings are necessary, even when concentrations of contaminants in the ambient air are low. The present invention relates to providing simple and economical means for cleaning certain surfaces that are adjacent to rollers utilized for forming toner images on receiver members.

In an electrophotographic machine a toner image is typically formed on an imaging member, transferred in a first transfer operation from the imaging member to an intermediate transfer member, and subsequently transferred in a second transfer operation from the intermediate transfer member to a receiver member (e.g., paper), whereupon the toner image is fixed to the receiver in a fusing station.

For full color high quality electrophotographic printing, it is known to employ a modular machine typically including four modules arranged in tandem fashion. Each module produces a respective single color toner separation image, e.g., a cyan, magenta, yellow, or black toner image. A receiver member is moved successively through the modules such that the respective single color toner images are sequentially transferred in registry to the receiver member. The receiver member, e.g., a paper sheet, can be electrostatically adhered to a transport belt, which transports the receiver member through the modules. After passing through the last module, the receiver member is moved through a fusing station where the unfused toner is fixed to the receiver member by heat and/or pressure. Each module can include a primary imaging roller (imaging cylinder) and a compliant intermediate transfer member (blanket cylinder). Arranged around the imaging cylinder in the direction of rotation are typically a charging station which can utilize a gridded corona charger, an exposure station for image-wise exposing the charged imaging cylinder so as to produce an electrostatic latent image, a development station for toning the latent image so as to produce a respective single color toner image, a primary transfer station wherein the respective single color toner image is electrostatically transferred to the blanket cylinder, and a cleaning station for cleaning the imaging cylinder prior to the next charging operation. A pre-clean corona charger may be mounted between the primary transfer station and the cleaning station, and additionally a pre-clean erase lamp may be mounted between the pre-clean corona charger and the cleaning station. The cleaning station can include a cleaning blade, a brush, or a rotatable member for contacting the surface of the imaging cylinder so as to remove residual untransferred toner particles therefrom. It is known to mount a sensor included in a densitometer immediately after the development station, which densitometer is used for monitoring toner coverage in a test patch located outside of the imaging area on the imaging cylinder. In the primary transfer station, the imaging cylinder forms a primary transfer nip with the blanket cylinder, and in a secondary transfer station, the blanket cylinder forms a secondary transfer nip for transferring the respective toner image to a receiver member, e.g., with the receiver member adhered to a transport belt such that the secondary transfer nip is formed by action of the blanket cylinder and an associated transfer roller or backup roller located behind the transport belt. A cleaning mechanism for the blanker cylinder is typically located after the secondary transfer station.

In an electrophotographic machine, image-wise exposure of an imaging cylinder can be done using a rastered laser beam and an associated polygon, as is well known. Periodic cleaning of such a polygon is typically required. It is possible to reliably clean the polygon inside the machine, e.g., by using an air jet or a cleaning roller, as disclosed for example in the Koguchi patent (U.S. Pat. No. 6,327,067). However, this requires a complicated apparatus. Alternatively, a LED writer including an array of lenses can be used for image-wise exposure, as disclosed for example in the Flynn, et al. patent (U.S. Pat. No. 4,947,195). It is noteworthy that such a LED writer is inherently much more amenable to cleaning than is the polygon apparatus, because the lenses of the writer which require the periodic cleaning are typically disposed in a rectangular arrangement, i.e., all the lenses can be cleaned at essentially the same time. However, there is a need for a simple and convenient way to clean such a lens array in situ, i.e., without requiring partial disassembly of the machine.

It is known to provide a removable replaceable sleeve member for an imaging cylinder or a blanket cylinder, as disclosed in the Chowdry, et al. patents (U.S. Pat. Nos. 6,456,816; 6,541,171; and 6,605,399), which are hereby incorporated by reference. A double-sleeved imaging cylinder or blanket cylinder is disclosed in the Chowdry, et al. patent (U.S. Pat. No. 6,377,772), which is hereby incorporated by reference.

The Shifley, et al. patents (U.S. Pat. Nos. 6,259,873; 6,263,177; and 6,484,002), which are hereby incorporated by reference, disclose a roller (such as a photoconductive roller or an intermediate transfer roller) which has a removable replaceable sleeve and a disconnectable supportive member which is disengaged and moved away from the roller so as to provide a free end for sleeve removal or replacement, the roller being supported in cantilevered fashion at the opposite end. With a new sleeve in place the supportive member is re-engaged to support the roller for operation. A mechanism can be provided for disconnecting/reconnecting supporting members from an imaging cylinder as well as from an associated blanket cylinder, thereby simultaneously leaving both cylinders supported in cantilever fashion, e.g., for sleeve replacement.

The Cormier, et al. patent (U.S. Pat. No. 6,394,943), which is hereby incorporated by reference, describes an image transfer drum inclusive of a mandrel having an air bearing to facilitate loading and removal of a resilient sleeve. The air bearing is provided with a pair of cooperating plates, one of which is scored with equally spaced and radially extending grooves. When urged together, the plates define a central air chamber and a plurality of radially extending passages serving to direct pressurized air radially from one end of the mandrel, at which end the sleeve can be removed and replaced. The pressurized air is conveyed to the central chamber via a pipe passing into the mandrel at the other end of the mandrel, at which other end the mandrel is supported in cantilever fashion during removal or replacement of a sleeve.

The Cormier, et al. provisional patent application (U.S. Provisional Patent Application Ser. No. 60/523,619), which is hereby incorporated by reference, discloses a double-sleeved roller inclusive of a mandrel similarly supported in cantilever fashion during replacement of a sleeve member. The mandrel provides an air bearing to facilitate removal or replacement of an outer sleeve. For replacement of an inner sleeve, a sleeve-replacement fixture is reversibly attached to the free end of the cantilevered mandrel. With the sleeve-replacement fixture attached, three air bearings are available to facilitate removal/mounting of the inner sleeve.

As is commonly known, contamination of certain critical surfaces of subsystem apparatus can result in reduced performance of an electrophotographic engine. Such contamination can include various types of particulates, e.g., toner dust, carrier dust, paper dust, hairs, and fibers. Moreover, aerosols such as fuser oil aerosols and the products of corona chemistry from corona chargers can contaminate surfaces. Despite a prevailing use of contamination control mechanisms, e.g., airflow systems, air conditioning systems, air purifying filters, and the like, the problem of lowered performance caused by contamination remains a fact of life in commercial electrophotographic machines, including modular electrophotographic color printing machines.

Thus, over a period of time of operation of a modular electrophotographic color printing machine employing, in the modules, LED writers having lens arrays, the lens surfaces of the lens arrays typically become contaminated, e.g., with particulate matter. The contamination reduces the amount of transmitted imaging light and thereby adversely affects image-wise exposure of corona-charged imaging cylinders. As a result, the lens surfaces typically require periodic cleaning. This can be a cumbersome process in a modular electrophotographic color-printing machine, where each LED writer is disposed close to the respective imaging cylinder. Typically, the LED writer is fixedly and precisely positioned with respect to the surface of the imaging cylinder, i.e., in practice the LED array is not retractable from the imaging cylinder. Were it in fact retractable, very little available space would typically be available for providing a suitable amount of retraction for a cleaning device to be inserted between imaging cylinder and lenses. Therefore, the imaging roller (which can be bulky and heavy) must be removed from the machine in order to clean the LED lenses. This is time consuming and also introduces a risk of damage to the roller, to the LED array, or to other subsystem elements.

The grids of gridded corona chargers can typically become contaminated by an accumulation of corona chemistry byproducts, which byproducts can desorb from the grids and cause blurring of images on the imaging cylinder. Or, the grids can be contaminated by particulate matter or by fibers, which can cause image defects as well as electrical arcing defects on an imaging cylinder surface. Thus each grid requires periodic cleaning, e.g., via wiping. While the inner surfaces of the grid can readily be cleaned by periodically wiping with a wiping mechanism internal to the corona charger, it is considerably more expensive to also clean the exterior surface of the grid by a mechanical device incorporated into the charger. In order to clean the exterior surface of a grid manually, e.g., by using a suitable cloth or a pad, the charger is typically removed from the machine.

Periodic cleaning of the corona wires of non-gridded corona chargers, sometimes used for the pre-clean charging function for imaging and blanket cylinders, can also be desirable. The low cost of such chargers can make it impractical to use a mechanical wiper integral with the charger. Non-gridded corona chargers are usually removed from the machine from time to time for manual cleaning of the corona wires.

Cleaning blades, which can be employed in cleaning stations, can become dirty after prolonged usage. As a result they require periodic cleaning, which typically necessitates removal of the blades from the machine. Other types of blade, such as for example doctor blades, scrapers, or skives, may similarly require periodic cleaning.

An erase lamp can be mounted prior to a cleaning station so as to illuminate an imaging cylinder for the purpose of regenerating the imaging cylinder between images, i.e., to remove ghost images. However, the erase lamp can accumulate exterior particulate or other contamination, thereby reducing the amount of transmitted light and thus compromising erase efficiency. Periodic cleaning of erase lamps is therefore usually necessary.

It is well known that iron carrier particles, which typically are a component of an electrophotographic developer, can be deposited on a photoconductor during toning of an electrostatic latent image via a magnetic brush. This type of deposition is sometimes referred to as "developer pickup" (DPU). It is known that in order to remove such iron particles from the photoconductor, a DPU scavenger device can be provided immediately after the toning station. The surface of the DPU scavenger device, which faces the photoconductor, requires periodic cleaning.

A sensor included in a densitometer for measuring toner lay-down can be located after the development or toning station and prior to the transfer station. Such a sensor can have a transparent protective surface that can gradually become dirty, e.g., by particulate contamination. For proper functioning of the densitometer, periodic cleaning of the transparent protective surface is typically required.

It will be evident that an electrophotographic machine is typically required to be partially disassembled for periodic cleanings of, for example, LED lens arrays, exterior surfaces of corona grids, corona wires, blades, sensors for densitometers, DPU scavengers, and erase lamps. These procedures can be cumbersome, time consuming, and therefore costly, especially for high speed modular printers where productivity is paramount.

It will be evident that there is a general need to provide in a (modular) electrophotographic engine a mechanism or apparatus to periodically clean, in situ, certain surfaces of subsystem components mounted around the periphery of a roller upon which a cleaning sleeve is mountable, e.g., to remove dust particles or other debris or contamination from these components. There is a particular need to be able to periodically clean the lens surfaces of a LED writer lens array such that the associated imaging roller remains supported in situ in the machine with the LED writer remaining unmoved from its operational position. Additionally, there can be a need to provide a mechanism or apparatus for easy periodic cleaning of other devices typically associated with an electrophotographic roller, such as erase lamps, sensors for densitometers, cleaning blades, doctor blades, DPU scavengers, charger grids included in gridded corona chargers, charger wires included in open-wire corona chargers, or rotatable members associated with the roller for operational use therewith. These needs can be met simply and cheaply by the subject invention.

SUMMARY OF THE INVENTION

The invention is a cleaning member or cleaning sleeve to remove contamination from a cleanable surface included in at least one electrophotographic process device located peripherally adjacent to a roller on which the cleaning member or sleeve can be temporarily mounted. A cleaning sleeve can be removably installed on an imaging cylinder, around which imaging cylinder can be located various process devices having exterior surfaces that are prone to contamination and which require periodic cleaning by the cleaning sleeve. Process devices which can include a cleanable surface are: a LED writer, corona chargers, a cleaning mechanism included in a cleaning station for cleaning the imaging cylinder, a developer pickup (DPU) scavenger device, a sensor included in a densitometer for measuring toner lay-down on the imaging cylinder, and a pre-erase lamp for use in regenerating the imaging cylinder. A particular type of surface amenable to cleaning by a cleaning sleeve of the subject invention is a lens surface included in an array of lenses incorporated in a LED writer.

The roller on which the cleaning sleeve is mountable, is operationally supported by a retractable support member at a disconnectable end and by a fixed support at the other end of the roller. In a condition in which the retractable support member is retracted such that the disconnectable end is supported in cantilever fashion by the fixed support, the cleaning sleeve is installable on the roller via the disconnectable end and subsequently activatable with motion so as to clean via rubbing a cleanable surface.

In a preferred embodiment, the cleaning sleeve includes a tubular substrate and a cleaning agency supported on the tubular substrate. The tubular substrate preferably includes at least one of the following materials: paper, cardboard, plastic, synthetic polymer, rubber, filaments, fabric, and metal. The cleaning agency can include one or more cleaning agents for removing, via direct contact, contamination from a cleanable surface. A preferred cleaning agent can be selected from the following categories of cleaning agent: brush, pad, woven material, fabric, cloth, rubber, sponge, and foam. Preferably, the tubular support can move freely on the exterior surface of the roller. Thus the tubular support preferably has an inner circumference at least as great as an outer circumference of the exterior surface of the roller, such that any difference between the inner circumference of the tubular support and the outer circumference of said exterior surface is a pre-selected difference. Preferably, the pre-selected difference is greater than about 1 mm, and a cleaning motion of the cleaning sleeve is a manual motion, which includes a longitudinal movement along the roller and/or a rotary movement about the longitudinal axis of the roller, with the roller remaining stationary during the cleaning motion.

In a certain embodiment of a cleaning sleeve the cleaning agency is formed as at least one strip running longitudinally on the cleaning sleeve in a manner such that each strip of cleaning agency is adjacent at least one strip which is free of any cleaning agency.

In another embodiment, a cleaning member when mounted on a roller has the form of an incomplete sleeve curved around a portion of the exterior surface of the roller, i.e., so as to leave uncovered a longitudinally extending portion of the exterior surface running parallel to the axis of rotation of the roller.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, some elements have been removed, and relative proportions depicted or indicated of the various elements of which disclosed members are composed may not be representative of the actual proportions, and some of the dimensions may be selectively exaggerated.

DETAILED DESCRIPTION OF THE PREFERRED EMBODIMENTS

Briefly, the invention relates to electrophotography and to electrophotographic cleaning apparatus, and in particular to a removable cleaning member temporarily mounted on a roller for the purpose of periodically cleaning a cleanable surface included in one or more process devices mounted peripherally adjacent to the roller, the roller being located in an electrophotographic machine such as for example a modular color printer. The cleaning is carried out via a motion of the cleaning member, which motion is preferably a rubbing motion, which includes longitudinal movement and/or rotary movement. The roller on which the cleaning member can be mounted is typically a primary imaging roller (imaging cylinder) or a compliant intermediate transfer member (blanket cylinder). In a preferred embodiment, the cleaning member is in the form of a sleeve or tube mounted around the roller. In another embodiment, the cleaning member is an incomplete tube or a curved sheet, which covers a portion of the exterior surface of the roller in manner such that, a longitudinal strip of the exterior surface, is not covered by the cleaning member.

In general, a variety of types and arrangements of elements, e.g., elements included in or associated with subsystem stations, may be mounted peripherally adjacent a roller such as an imaging cylinder or a blanket cylinder used in a commercially available electrophotographic printing machine. Typically, such an element is an electrophotographic process device having a cleanable surface, i.e., a surface which is prone to contamination, which surface is contactable by the cleaning sleeve, and which surface can be cleaned periodically by moving the cleaning sleeve in any suitable manner, e.g., so as to rub the cleanable surface. It will be understood that a removable cleaning member or cleaning sleeve of the invention may be useful for cleaning a variety of surfaces that may be located on, or associated with, any elements or mechanisms which are operationally in close proximity to (or which face) a roller employed in such a machine, with the roller remaining in situ in the machine while the cleaning sleeve is being used.

Figure 1:
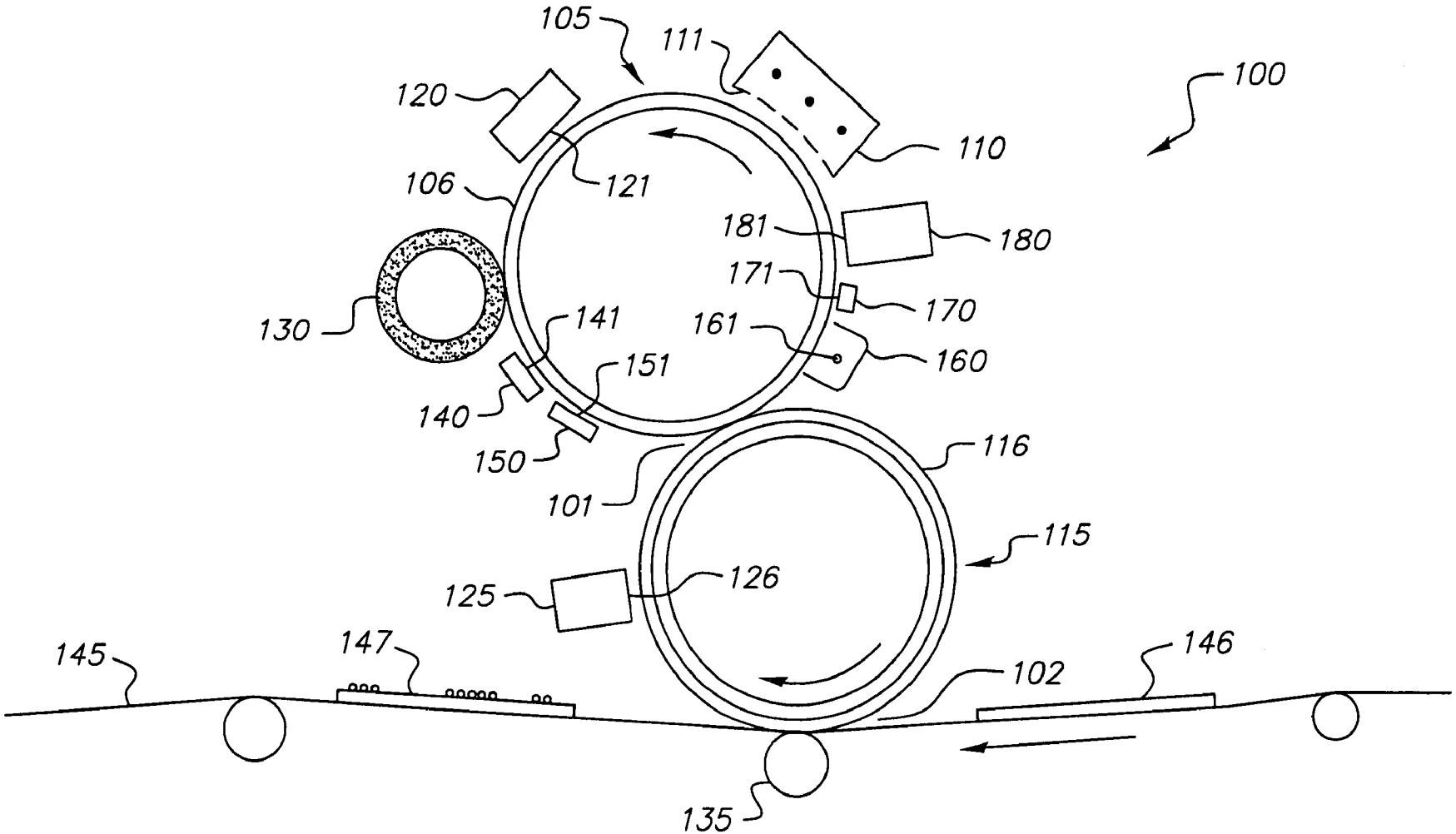
FIG. 1 is exemplary of an imaging module, included in an electrophotographic printer, wherein the present invention can have use.

FIG. 1 is an exemplary figure showing in side view certain components of an imaging module 100 included in a modular electrophotographic printer, which imaging module includes electrophotographic devices situated in proximity to both an imaging cylinder 105 and a blanket cylinder 115. Module 100 has features in common with the type of module, for example, included in the commercially available NexPress 2100 digital color printer. Mounted peripherally adjacent to imaging cylinder 105 are various electrophotographic devices which can have cleanable surfaces for periodic cleaning according to the invention. These devices are, in counter-clockwise order: a gridded corona charger (primary charger) 110, a LED writer 120, a development station 130, a DPU scavenger 140, a sensor for a densitometer 150, a non-gridded (open wire) pre-clean corona charger 160, a pre-clean erase lamp 170, and a cleaning station 180. Also shown generically is a cleaning station 125 mounted peripherally adjacent blanket cylinder 115. The term "peripherally adjacent" thus includes adjacency with a suitable spacing between a roller, and an associated device (e.g., devices 110, 120, 150, 160, and 170), as well as actual physical contact of the roller with an associated device (e.g., devices 130, 140, and 180). Furthermore, "peripherally adjacent" also includes adjacency after any associated retractable device has been suitably retracted in order that a cleaning sleeve can be mounted on the roller.

Module 100 is for making toner images of a specific color for transfer to receiver members, such as receiver member 146. Receiver member 146 is adhered to a transport web 145, which is moved through a pressure nip 102 formed by roller 115 and a transfer backup roller 135. A toner image formed on surface 106 of imaging cylinder 105 is transferred in pressure nip 101 to a compliant surface 116 of blanket cylinder 115 and from thence to receiver member 146. Toned receivers, such as receiver 147, are moved downstream on belt 145 and may be passed through subsequent modules (not shown) then ultimately transported to a fusing station (not shown). To form a toner image, surface 106 is charged by charger 110, exposed image-wise by LED writer 120, and toned by development station 130. Typically, the development station 130 utilizes a magnetic brush in which iron carrier particles transport tribo-electrically charged toner particles (and occasional iron particles-DPU) from station 130 to be deposited on surface 106. These DPU particles are typically removed from surface 106 by the DPU scavenger unit 140. A reflection densitometer sensor 150 can be used to monitor the amount of toner lay-down in a test patch area included in surface 106. After transfer of the toner image in nip 101, the surface 106 is charged by the pre-clean corona charger 160 and then exposed to erase lamp 170 before moving to cleaning station 180 where surface 106 is cleaned of residual toner particles prior to being recharged by charger 110 for the next image.

Included in LED writer 120 is an array of lenses, which lenses can have cleanable surfaces indicated by numeral 121. Also, scavenger 140 can have a cleanable surface 141, sensor 150 can have a transparent cleanable surface 151, the non-gridded charger 160 can have a cleanable surface of wire 161, pre-clean lamp 170 can have a cleanable light-transmitting surface 171, cleaning station 180 can have a cleanable surface 181, and the exterior surfaces of grid 111 can be cleanable surfaces. Charger 160 can alternatively be a gridded charger having cleanable grid surfaces. The cleaning station 180 may include for example a roller, brush, or blade in contact with surface 106, which roller, brush, or blade (not illustrated) can have one or more cleanable surfaces suitable for cleaning with a cleaning sleeve of the invention.

As is well known, the location and spacing of LED writer 120 with respect to the outer surface 106 of roller 105 must be maintained with high precision, whereby the associated high tolerances usually preclude a mechanized movement of the writer 120 in a radial direction, e.g., a retraction away from surface 106. Thus the location of writer 120 is typically fixed and is not adjustable, e.g., when roller 105 is removed from the machine. On the other hand, most if not all of the other devices (10, 130, 140, 150, 160, 170, and 180) are typically retractable or removable (i.e., with rollers 105, 115 in operational position).

A feature of module 100 is the ability to mechanically move cylinders 105 and 115 apart, i.e., via a retractive movement of cylinder 115 while keeping roller 105 unmoved. Such a movement of cylinder 115 also typically requires corresponding movements of web 145 and transfer backup roller 135. Separation of rollers 105 and 115 so as to be out of contact with one another is a necessary precursor to the mounting of a cleaning sleeve of the invention around imaging cylinder 105. Furthermore, in order to mount a cleaning sleeve around blanket cylinder 115, both web 145 and roller 135 are to be retracted so as to open the nip 102. Additionally, in order to be able to mount a cleaning sleeve, retraction may also be required of certain contacting devices, such as for example devices 130, 140, and 180. In particular, cleaning station 180 can include a rotatable process device retractably adjacent roller 105, e.g., a rotatable brush.

In certain instances the subject invention can be used for cleaning the surface of a device peripherally adjacent to a blanket cylinder, e.g., a cleaning device 125 of cylinder 115 having a cleanable surface 126. Alternatively, in certain machines a component (not illustrated) other than a cleaning member may be located adjacent a blanket cylinder, which component can have a surface cleanable by a cleaning brush of the subject invention.

Figure 2:
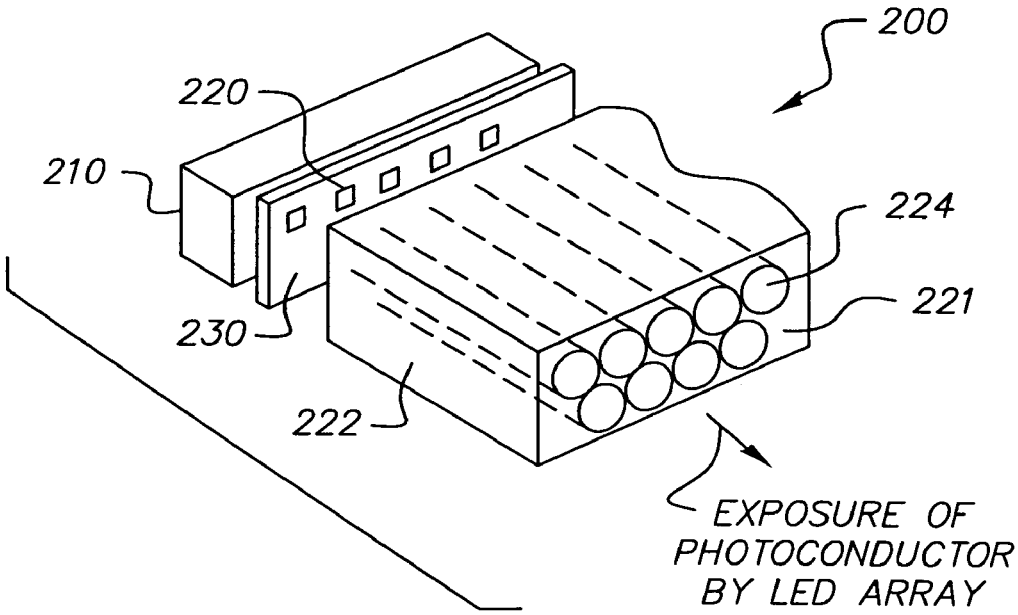
FIG. 2 shows an exemplary LED writer for inclusion in the module of FIG. 1.

FIG. 2 shows an exemplary LED, imaging device 200 used for image-wise exposure of the imaging cylinder of FIG. 1. Included in device 200 are print-head 210 having an LED array 220 with several thousand LEDs, a diffusion plate 230 for defocusing the LED beams emitted by array 220, and a bundle 222 of gradient index optical fibers 224 (e.g., Selfoc, trademark of Nippon Sheet Glass, Ltd.), the optical fibers 224 terminating in the surface 221. It is surface 221, and the like, which can be a cleanable surface for cleaning by a cleaning member of the invention, such as surface 121 of FIG. 1.

Turning next to FIG. 3, a roller assembly 300 for use with a cleaning sleeve of the invention is schematically depicted in side view. Installation of a cleaning sleeve is illustrated by FIGS. 3*a*, 3*b*, and 3*c*. Longitudinal and rotary movements of the cleaning sleeve for purpose of cleaning a cleanable surface are separately indicated in the side and end views of FIGS. 3*d* and 3*e*, respectively.

Figure 3A:
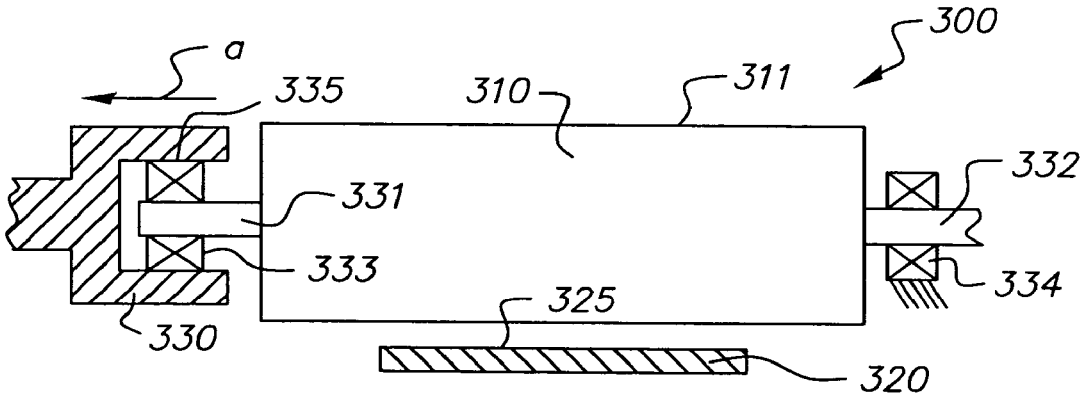
FIGS. 3*a*, 3*b*, and 3*c* illustrate schematically, in side view, installation of a cleaning sleeve of the invention on an exterior surface of a roller, e.g., an imaging roller included in the module of FIG. 1.

Roller assembly 300 of FIG. 3*a* includes roller 310 in an electrophotographic machine, the roller having an exterior surface 311. The roller 310 includes a shaft 331 rotatably mounted in bearing 333 and a shaft 332 rotatably supported in bearing 334. Shaft 331 is supported by a disconnectable member 330 which is preferably retractable in the direction of arrow, a, and which operationally grips the housing of bearing 333 (housing not shown). Typically, but not necessarily, the housing of bearing 333 is separable from member 330 at interface 335 such that the bearing remains captured around shaft 331 when member 330 is retracted, with the outer diameter of the bearing housing, i.e., at interface 335, being smaller than the outer diameter of exterior surface 311.

Peripherally adjacent exterior surface 311 is at least one electrophotographic device including a surface which is prone to contamination and which is cleanable by a cleaning sleeve of the invention. Any such electrophotographic device is generically represented by device 320 having cleanable surface 325. Device 320 can include any member or unit included in an electrophotographic subsystem. Cleanable surface 325 can include any surface associated with or included in a device 320. Device 320 can be a static member or can be a rotatable process device, such as for example a roller (not illustrated) operationally contacting roller 310, which roller (e.g., a cleaning roller) can be retracted when a cleaning operation is carried out using a cleaning sleeve of the invention.

Exterior surface 311 typically represents the outer surface of a roller, which does not embody a sleeve member. Alternatively, exterior surface 311 can be the outer surface of a sleeved roller, i.e., the exterior surface of a sleeve member disposed in intimate contact around a mandrel (sleeve member and mandrel not illustrated in FIG. 3*a*). As another alternative, exterior surface 311 can be the outer surface of a double-sleeved roller, i.e., the exterior surface of an outer sleeve member in intimate contact with an inner sleeve member that is disposed in intimate contact around a mandrel (double-sleeved roller not illustrated in FIG. 3*a*). In yet another alternatives, the exterior surface can be generated by the removal of a sleeve member from a sleeved roller (see FIGS. 4 and 5).

Figure 3B:
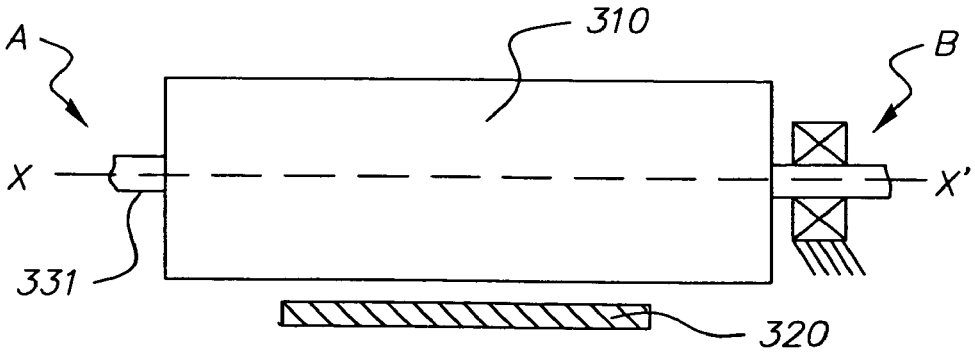

In FIG. 3*b*, roller 310 having longitudinal axis of rotation labeled X . . . X', is shown with support member 330 retracted so as to leave free the disconnectable end, labeled A, over which end a cleaning member may be installed by a longitudinally directed movement, e.g., a slidable movement. (For a purpose of clarity, bearing 333 is not shown in FIG. 3*b*). The free end, A, is thus supported in cantilever fashion by a non-retractable or fixed support member located at the other end of the roller, labeled B. For example, end A can be supported in cantilever fashion by bearing 334 being connected to a frame member of the machine, as indicated.

Figure 3C:
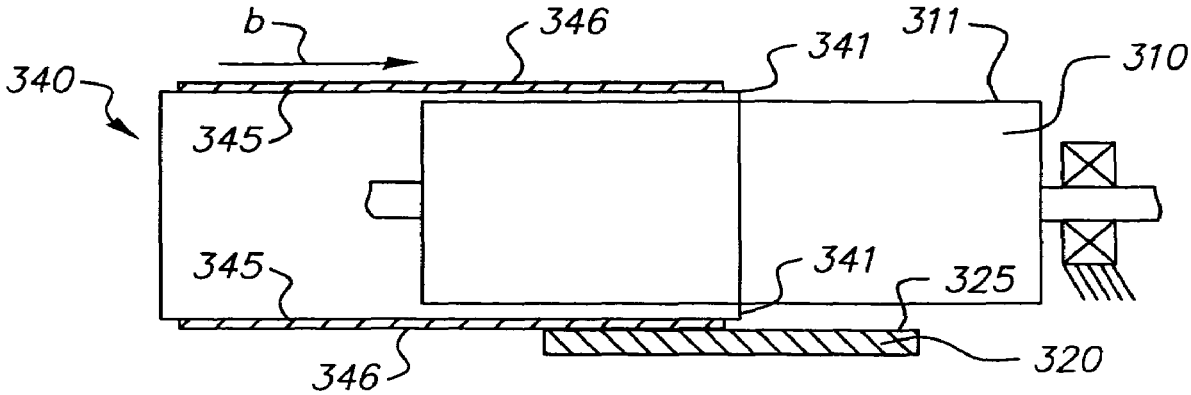

In FIG. 3*c*, the cleaning member is a cleaning sleeve 340, shown being moved in the direction of arrow, b, for installation around at least a portion of exterior surface 311. Cleaning sleeve 340 includes a tubular substrate 345, with the tubular substrate supporting a cleaning agency 346. Cleaning agency 346 generally includes at least one cleaning agent member, which can be adhered or bonded to the tubular substrate 345 (see below). Alternatively, the cleaning agency 346 can be an integral part of the tubular substrate 345.

Figure 3D:
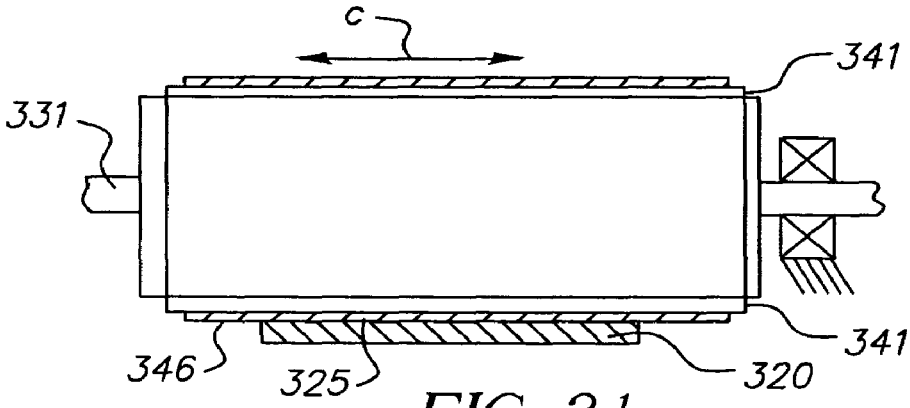
FIGS. 3*d* and 3*e* show side and end views which respectively indicate longitudinal and rotary movements of the cleaning sleeve on the roller of FIG. 3*c*, which movements for purpose of cleaning a cleanable surface, e.g., a surface located on a device in the module of FIG. 1.

As shown for purpose of illustration in FIG. 3*d*, on average during cleaning, the cleaning sleeve 340 can be approximately centrally located on roller 310, with the cleaning agency 346 contacting the cleanable surface 325 of member 320. However, such an average central location of cleaning sleeve 340 is not required, and any suitable average location can be used such that at least a portion of exterior surface 311 is covered at any time during the cleaning process. Preferably, the tubular support 345 can move freely on the exterior surface 311 of the roller. Cleaning sleeve 340 can be activated for cleaning of the surface 325 by provision of a longitudinal movement, including for example a reciprocating movement indicated by the double-headed arrow, c. A longitudinal movement is thus a movement approximately parallel to axis X . . . X'. For ease of longitudinal movement, preferably a manual longitudinal movement, it is preferred that cleaning sleeve 340 be not close-fitting, i.e., the cleaning sleeve when installed on roller 310 preferably has an inner circumference at least as large as the outer circumference of exterior surface 311, with any difference between these circumferences preferably being a pre-selected difference. A finite pre-selected difference is indicated by the gap 341. Gap 341, although illustrated for simplicity as existing around the entire circumference of roller 310, need not however have a uniform spacing circumferentially. Moreover, cleaning sleeve 340 can touch exterior surface 311 in one or more places, e.g., during the cleaning of cleanable surface. Thus gap 341 as illustrated is merely indicative of a non-zero pre-selected difference between the inner circumference of the cleaning sleeve 340 and the outer circumference of surface 311. A pre-selected difference is preferably greater than zero, and more preferably is greater than about 1 mm.

Figure 3E:
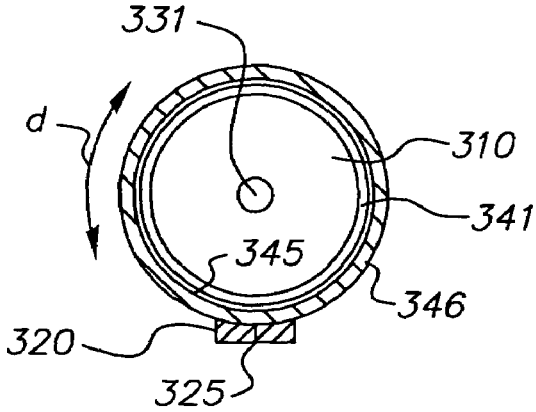

As illustrated in FIG. 3*e*, the cleaning sleeve 340 can be given a rotary movement about axis X . . . X' by any suitable means including mechanical or manual activation, which rotary movement can include for example a reciprocating rotary movement indicated by the double headed arrow, d. Preferably, the cleaning sleeve 340 can be manually moved around the roller, i.e., with roller 310 remaining stationary, and preferably where there is a finite pre-selected difference between the inner circumference of the cleaning sleeve 340 and the outer circumference of surface 311.

In summary, in order to clean the cleanable surface 325, a cleaning sleeve 340 can be activated with a motion which includes a longitudinal movement and/or a rotary movement of the cleaning sleeve about the longitudinal axis X . . . X'. For example, cleaning sleeve 340 can be manually activated, e.g., for longitudinal movement, for rotation, or for a combination of these movements, by simply grasping the sleeve and thereby imparting a desired motion to the sleeve, including reciprocating movements.

The term "cleaning agency" includes any suitable material which, can be useful for cleaning any cleanable surface included in an electrophotographic device situated peripherally adjacent a roller on which a cleaning sleeve can be disposed. The cleaning agency 346 of cleaning sleeve 340 can include at least one cleaning agent preferably selected from the following categories of cleaning agent: brush, pad, woven material, fabric, cloth, rubber, sponge, and foam. A cleaning agent can be a discrete member. A preferred type of cleaning agent is a brush. A cleaning agent can be circumferentially disposed on the cleaning sleeve, i.e., so as to substantially cover the area of a tubular member as shown in FIG. 3. Alternatively, the cleaning agent can be circumferentially discontinuous so as to cover only a portion of the tubular member (see for example FIG. 7*b*). Thus the cleaning agency can include a plurality of cleaning agents supported on tubular substrate 345, which cleaning agents can be of a same type or of different types. Further, the cleaning agency can conform to any portion of any suitable cleaning member configuration.

The tubular substrate 345 can be a rigid hollow cylinder. Alternatively, tubular substrate 345 can have a degree of flexibility and/or be stretchable. Tubular substrate 345 can be multi-layered and/or reinforced with reinforcing material, and preferably includes at least one of the following materials: paper, cardboard, plastic, synthetic polymer, rubber, filaments, fabric, and metal. Preferably, the inner surface of the tubular substrate 345 is smooth so as not to damage the exterior surface 311 when moved thereon, either during mounting or during cleaning operations (inner surface of tubular substrate not labeled in FIG. 3).

Preferably, tubular substrate 345 and cleaning agency 346 are made of inexpensive materials so that the cleaning sleeve 340 can be a disposable unit. Alternatively, sleeve 340 is re-usable, i.e., cleaning agency 346 can be cleaned for re-use, e.g., outside of the machine by any suitable method.

Figure 4A:
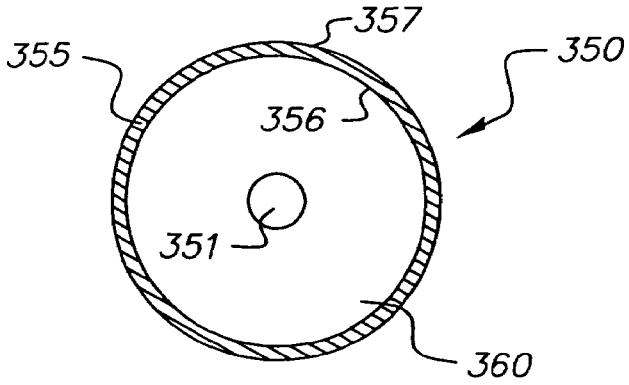
FIGS. 4*a*, 4*b*, 4*c*, and 4*d* schematically show, in cross-section: an operational sleeve member mounted on a mandrel included in a roller (FIG. 4*a*); removal from the mandrel of the sleeve member (FIG. 4*b*); installation of a cleaning sleeve of the invention around the mandrel (FIG. 4*c*); and rotary cleaning movement of the cleaning sleeve (FIG. 4*d*)
Figure 4B:
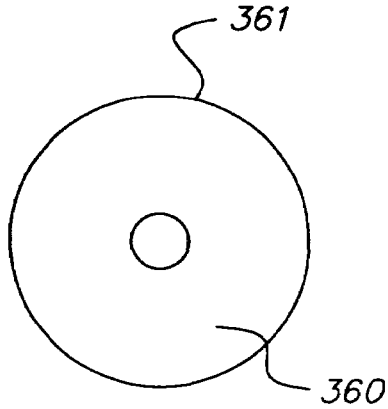
Figure 4C:
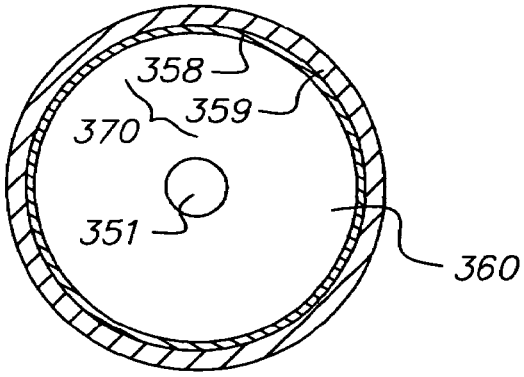

Periodic cleaning of cleanable surface by a cleaning sleeve can be conveniently done when a sleeve member included in a sleeved roller has been removed for replacement. In FIG. 4*a*, a single-sleeved roller 350 is shown in end view, in which roller a sleeve member 355 having an operational surface 357 is mounted on a mandrel 360 including a shaft 351 analogous to shaft 331 of FIG. 3*a*. Operational sleeve member 355, e.g., a photoconductive sleeve member or a blanket sleeve member operationally included in an electrophotographic machine, grips surface 356 of mandrel 360 with a suitable predetermined interference. Mandrel 360 can be provided in known fashion with a set of circumferentially disposed holes (not illustrated) connectable to a source of pressurized air (not illustrated). Thus sleeve member 355 can be removed from mandrel 360 by connecting the circumferentially disposed holes to the source of pressurized air so as to expand the sleeve member for slidable removal of the sleeve member from the mandrel, resulting in the configuration shown in end view in FIG. 4*b*, wherein the bare mandrel is supported in cantilever fashion in manner similar to that described in reference to FIG. 3. Surface 361 of mandrel 360 is an exterior surface around which a cleaning sleeve 370 can be mounted, as shown in FIG. 4*c*. Cleaning sleeve 370 includes a tubular substrate 358 supporting a cleaning agency 359. Tubular substrate 358 and cleaning agency 359 respectively can have similar characteristics and material properties as the above-described tubular substrate 345 and cleaning agency 346 of FIG. 3.

Figure 4D:
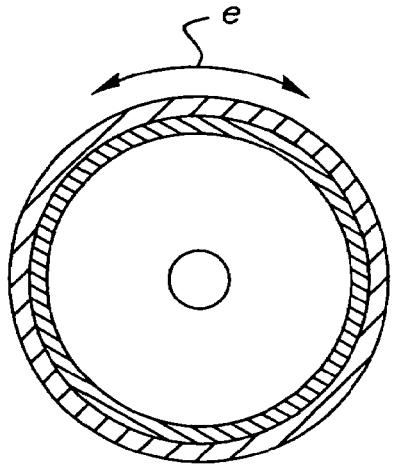

Cleaning sleeve 370 can be stretchable and when installed can fit snugly, on exterior surface 361, e.g., in non-slip fashion, with the pre-selected difference described in reference to FIG. 3 being zero. If longitudinal motion of cleaning sleeve 370 is precluded, a rotational movement can be imparted to this sleeve by a rotation of the entire roller, as indicated in FIG. 4*d*, in which the double headed arrow, e, indicates that the rotational movement can be a reciprocating movement. With longitudinal motion precluded, the rotational movement indicated by arrow, e; is preferably imparted by a drive mechanism, e.g., including a motor (drive mechanism not illustrated). A snugly-fitting sleeve cleaning sleeve 370 having a suitable pre-selected interference with mandrel 360 can be installed on the mandrel by using the aforementioned source of pressurized air so as to expand the cleaning sleeve for slidable mounting thereof on to the mandrel, i.e., over the end of shaft 351.

Alternatively, the pre-selected difference between the inner circumference of tubular substrate 358 and surface 361 can be finite (not illustrated explicitly in FIG. 4) such that sleeve 370 can be (manually) moved around the (stationary) mandrel 360 as indicated by arrow, e, and/or moved longitudinally on the mandrel.

Figure 5A:
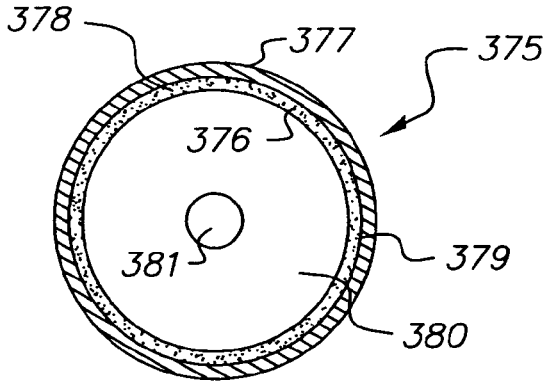
FIGS. 5*a*, 5*b*, 5*c*, and 5*d* schematically show, in cross-section: a double-sleeved roller including a mandrel with an inner sleeve member grippingly mounted on the mandrel and an outer sleeve member operationally mounted on the inner sleeve member (FIG. 5*a*); removal of the outer sleeve member (FIG. 5*b*); installation of a cleaning sleeve of the invention around the inner sleeve member (FIG. 5*c*); and rotary cleaning movement of the cleaning sleeve (FIG. 5*d*)
Figure 5B:
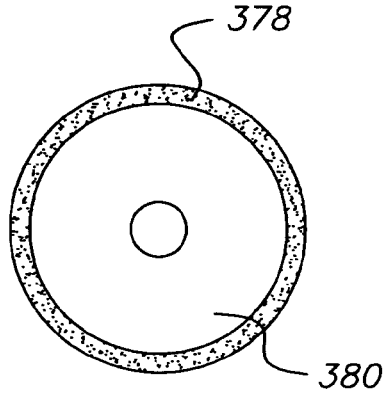
Figure 5C:
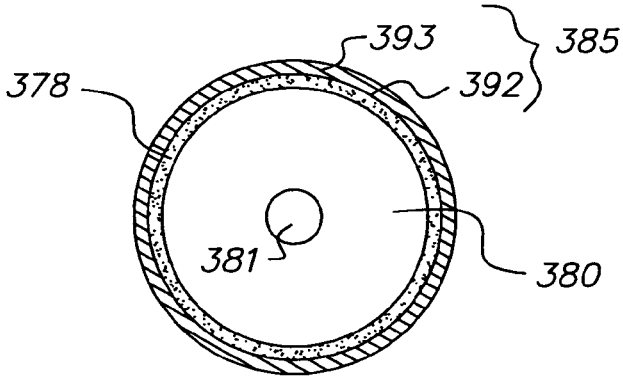

In FIG. 5*a*, a double-sleeved roller 375 is shown in end view, in which roller an outer sleeve member 379 having an operational surface 377 is mounted with a suitable pre-selected interference on an inner sleeve member 378, with the inner sleeve member grippingly mounted on surface 376 of a mandrel 380 including a shaft 381 analogous to shaft 331 of FIG. 3*a*. Mandrel 380 can be provided in known fashion with a set of circumferentially disposed holes (holes not covered by inner sleeve member 378 and not illustrated) connectable to a source of pressurized air (not illustrated). Thus outer sleeve member 379 can be removed from roller 375 (e.g., for replacement) by connecting these circumferentially disposed holes to the source of pressurized air so as to expand the outer sleeve member for slidable removal of the outer sleeve member over and off inner sleeve member 378, resulting in the configuration shown in end view in FIG. 5*b*, wherein the mandrel is supported in cantilever fashion in manner similar to that described in reference to FIG. 3. Surface 391 of inner sleeve member 378 is an exterior surface around which a cleaning sleeve 385 can be mounted, as shown in FIG. 5*c*. Cleaning sleeve 385 includes a tubular substrate 392 supporting a cleaning agency 393. Tubular substrate 392 and cleaning agency 393 respectively can have similar characteristics and material properties as the above-described tubular substrate 345 and cleaning agency 346 of FIG. 3.

Figure 5D:
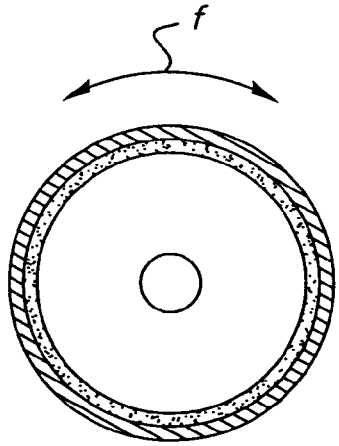

Cleaning sleeve 385 can be stretchable and when installed can fit snuggly on exterior surface 391, e.g., in non-slip fashion, with the pre-selected difference described in reference to FIG. 3 being zero. If longitudinal motion is precluded, a rotational movement can be imparted to the cleaning sleeve 385 by a rotation of the entire roller, as indicated in FIG. 5*d*, in which the double headed arrow, f, indicates that the rotational movement can be a reciprocating movement. The rotational movement indicated by arrow, f, is preferably imparted by a drive mechanism, e.g., including a motor (drive mechanism not illustrated).

Alternatively, the pre-selected difference between the inner circumference of tubular substrate 392 and surface 391 can be finite (not illustrated explicitly in FIG. 5) such that cleaning sleeve 385 can be (manually) moved around the (stationary) inner sleeve member 378 as indicated by arrow, f, and/or moved longitudinally on exterior surface 391.

Figure 6A:
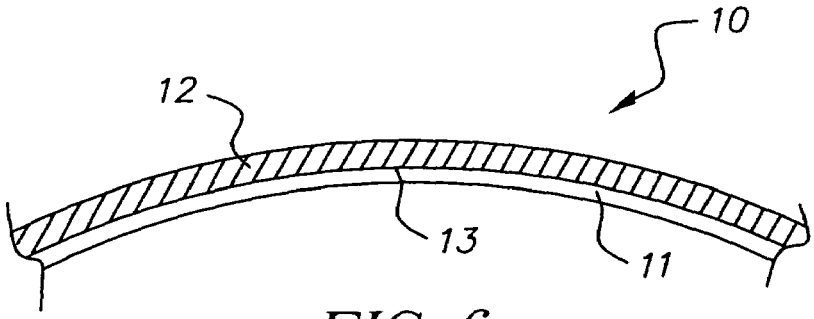
FIGS. 6*a*, 6*b*, 6*c*, and 6*d* schematically illustrate cross-sections of portions of cleaning sleeves of the invention in which a cleaning agency is supported by a tubular substrate, the cleaning agency being in the form of: a circumferential layer (FIG. 6*a*); one or more cleaning pads (FIG. 6*b*); one or more cleaning blades (FIG. 6*c*); a brush mounted on a circumferential backing layer (FIG. 6*d*)
Figure 6B:
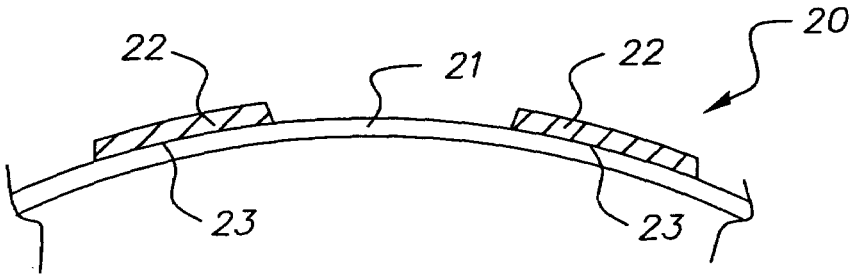
Figure 6C:
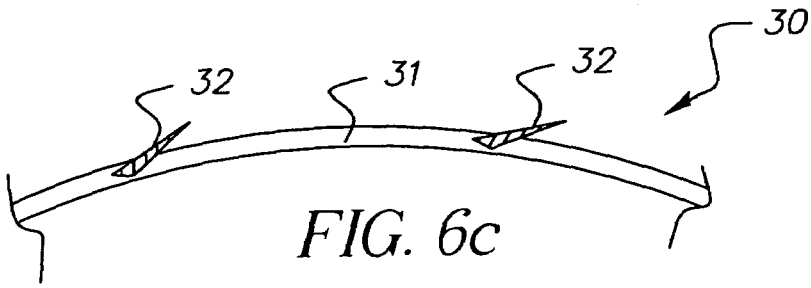
Figure 6D:
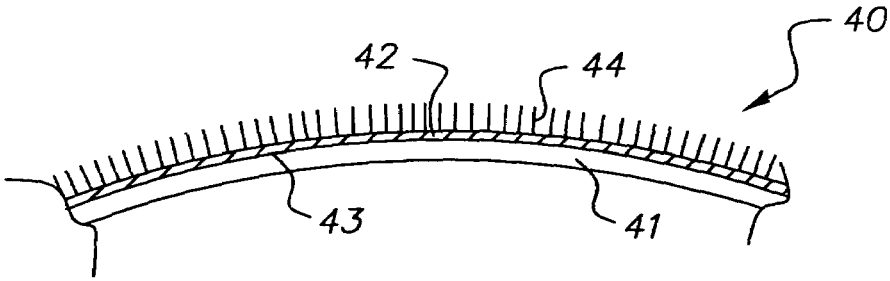

FIGS. 6*a*, 6*b*, 6*c*, and 6*d* schematically illustrate cross-sections of certain cleaning sleeve embodiments of the invention in which a cleaning agency is supported by a tubular substrate, the tubular substrate incorporating one or more layers and the cleaning agency being in the form of: a circumferential layer (FIG. 6*a*); one or more cleaning pads (FIG. 6*b*); one or more cleaning blades (FIG. 6*c*); or a brush formed on a circumferential backing layer (FIG. 6*d*).

FIG. 6*a* illustrates in cross-section a cleaning sleeve 10 having the form of a tubular substrate 11 supporting a layer of circumferentially disposed cleaning agent 12, the cleaning agent layer being in direct contact with outer surface 13 of the tubular substrate 11. Layer 12 can be made of bristles, e.g., in form of a brush with the bristles embedded in substrate 11, or alternatively bonded thereto. Furthermore, layer 12 can be a circumferential pad, which pad can include the following: woven material, fabric, cloth, rubber, sponge, or foam. The cleaning agent, layer 12, which can incorporate one or more layers, can be bonded to substrate 11, e.g., by an adhesive. Layer 12 can extend along the length of tubular substrate 11, or alternatively can cover a portion of the area of surface 13. Tubular substrate 11, which can be flexible or rigid as may be required, preferably includes at least one of the following materials: paper, cardboard, plastic, synthetic polymer, rubber, filaments, fabric, and metal. Substrate 11 includes one or more layers, and can furthermore include a reinforcing material.

FIG. 6*b* illustrates in cross-section a cleaning sleeve 20 having the form of a tubular substrate 21 supporting one or more cleaning agent pads 22 adhered or bonded to outer surface 23 of the tubular substrate, where substrate 21 has characteristics similar to those of substrate 11 and pads 22 can include materials similar to those of layer 12 of FIG. 6*a*. Pads 23 extend longitudinally along the length of tubular substrate 21, each pad covering a portion or substantially all of that length.

FIG. 6*c* illustrates in cross-section a cleaning sleeve 30 having the form of a tubular substrate 31 supporting one or more cleaning agent blades 32, which blades can be scrapers or skives. Substrate 31 includes one or more layers. Blades 32, which can be rigid or flexible, are formed of any suitable material. Blades 32, shown embedded in layer 31, can alternatively be attached to a supporting layer bonded to substrate 31 (supporting layer not illustrated). Blades 32 extend longitudinally along the length of tubular substrate 31, each blade covering a portion or substantially all of that length. Substrate 31 can be rigid or it can be flexible.

FIG. 6*d* shows an example of a cleaning sleeve having a cleaning agent, e.g., a brush, formed on a backing layer. FIG. 6*d* illustrates in cross-section a cleaning sleeve 40 in the form of a tubular substrate 41 having outer surface 43 to which is bonded a backing layer 42 supporting brush fibers 44. Substrate 41 can be rigid or it can be flexible, likewise backing layer 42. Substrate 41 can include more than one layer (not separately shown). Layer 42 can be made of any suitable backing layer material. The plurality of fibers 44 can include the following types of fibers: bristles, hairs, or filaments. Fibers 44 preferably include fibers made of a polymeric material, which polymeric material includes an acrylic material. More than one type of fiber can be used. The fibers 44 preferably have lengths in a range of approximately between 3 mm-30 mm.

FIGS. 7*a*, 7*b*, 7*c*, and 7*d* are schematically illustrated additional embodiments of cleaning sleeves of the invention.

Figure 7A:
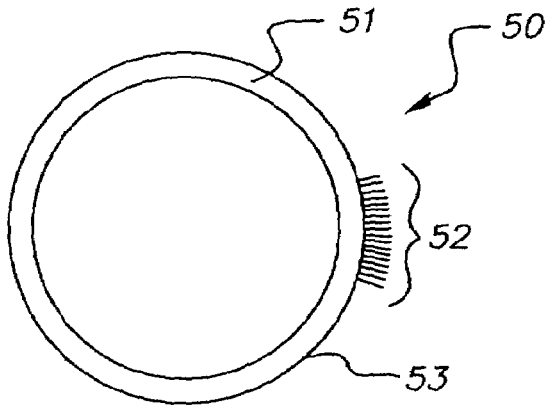
FIGS. 7*a* and 7*b* respectively show schematic cross-sectional and side views of a cleaning sleeve including a cleaning agency formed as a longitudinally extending brush supported on a tubular substrate, the brush adjacent a longitudinally extending portion of the tubular substrate not covered by the brush.
Figure 7B:
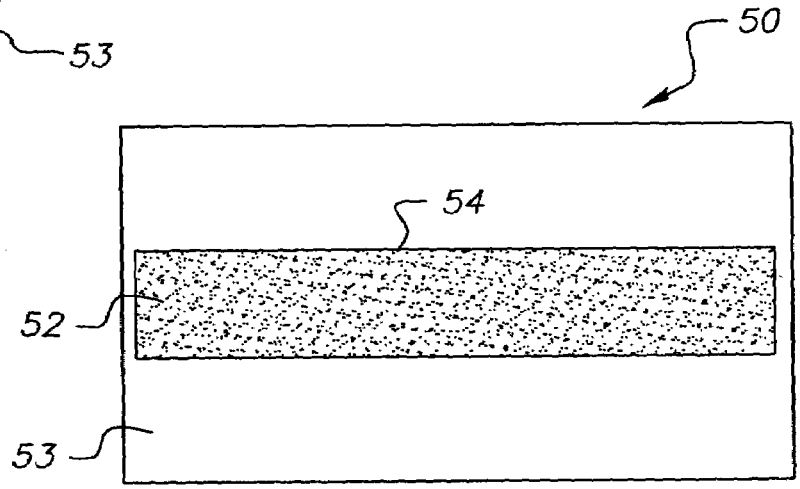

FIG. 7*a* shows in cross-section, and FIG. 7*b* shows in side view, a cleaning sleeve 50 having a cleaning agent in the form of a brush. Embodiment 50 is formed as a tubular substrate 51 having outer surface 53 on which is bonded a plurality of brush fibers 52 forming a longitudinally extending brush 54. The brush 54 has a circumferential width smaller than the circumference of surface 53, i.e., brush 54 covers a portion of substrate 51. For example, the remainder of surface 53 or a portion thereof not covered by brush 54 can be bare. Tubular substrate 51 is similar in all respects to substrate 11 of the embodiment 10 of FIG. 6*a*, and the plurality of brush fibers 52 are similar in composition and length to the plurality of fibers 44 of embodiment 40 of FIG. 6*d*. Embodiment 50 exemplifies brush embodiments of a cleaning agency in which at least one brush-free strip runs the length of the cleaning sleeve. Brush 54 can be a relatively narrow longitudinally extending strip adjacent a relatively wide brush-free strip, as illustrated in FIG. 7*b*. Alternatively, more than one relatively narrow brush similar to brush 54 can be used for the cleaning agency, wherein each brush strip preferably alternates with a brush-free strip. As another alternative, a brush, which runs the length of the cleaning sleeve, can have a spiral or helical form (not illustrated).

It will be evident that any suitable cleaning agency in the form of a longitudinally extending strip can be used, e.g., a longitudinal pad. Moreover, more than one relatively narrow longitudinal strip of cleaning agency can be used, such that each cleaning agency strip preferably alternates with a strip free of cleaning agency.

Thus a cleaning agency including a plurality of cleaning agents can be supported on a common substrate, which plurality can include more than one type of cleaning agent. In certain applications of a cleaning sleeve, more than one or different types of cleaning agent may be disposed thereon to simultaneously clean more than one surface, i.e., by preferably using longitudinal movement(s) of the cleaning sleeve. In order to properly guide a plurality of cleaning agents so as to properly clean the corresponding surfaces, fiducial marks may be placed for example on the trailing edge of the cleaning sleeve, which fiducial marks can be lined up with respective fiducial marks located for example on the free end of the roller.

Figure 7C:
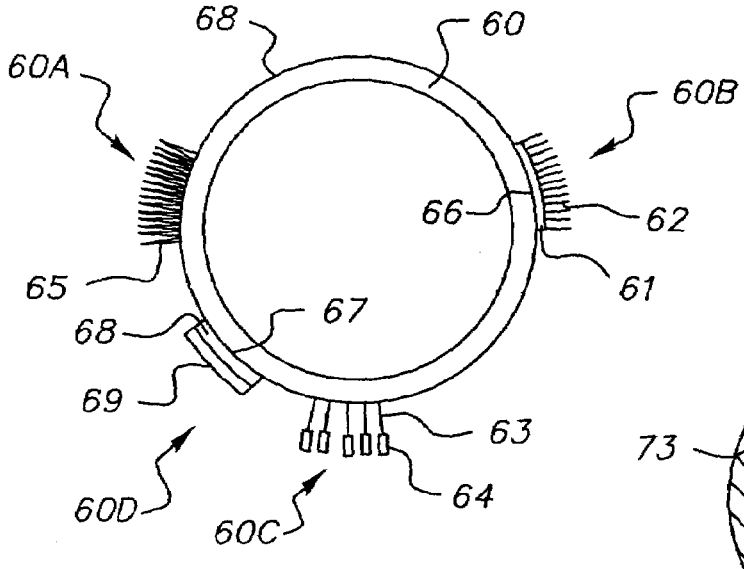
FIG. 7*c* schematically illustrates in cross-section several exemplary cleaning agents including a cleaning agent carrying a cleaning aid, which cleaning agents are shown supported in common on a tubular substrate.

FIG. 7*c* schematically illustrates, in cross-section, certain embodiments of cleaning agents, 60A, 60B, 60C, and 60D, which embodiments can be supported by a substrate such as tubular substrate 60, singularly or in any suitable plural member. The substrate 60 is similar in all respects to tubular substrate 11 of the embodiment 10 of FIG. 6*a*.

The cleaning agent embodiment labeled 60A includes a longitudinally extending brush, which is geometrically similar to brush 54 of embodiment 50 (FIG. 7*a*) except that the fibers 65 are made of a different type of fibers than fibers 52. A cleaning sleeve substrate 60 can include more than one longitudinally disposed brush, such as for example brushes having different types of fibers, e.g., a brush having fibers 65 and another brush having fibers similar to fibers 52 of embodiment 50 of FIG. 7*a*.

Cleaning agent embodiment labeled 60B includes a longitudinally extending brush including fibers 62 supported by a strip of backing layer 61, with the backing layer material bonded at interface 66 to tubular member 60. Characteristics of backing layer 61 and fibers 62 are respectively similar in all respects to those of backing layer 42 and fibers 44 of embodiment 40 of FIG. 6*d*.

In certain preferred embodiments of the invention, a cleaning aid can be used in conjunction with a cleaning agency. For example, a cleaning aid can be adhered to a cleaning agent, absorbed by the cleaning agent, or otherwise carried by the cleaning agent, and a specific cleaning aid can be tailored to a particular type of contamination. A cleaning aid is a material, which can include liquid and/or particulates. A liquid cleaning aid can include a cleaning chemical, which cleaning chemical can for example loosen, soften, or dissolve contamination material located on a surface being cleaned. A liquid included in a cleaning aid can for example be an organic solvent, water, or any suitable liquid. Particulates included in a cleaning aid can for example be an abrasive material, e.g., finely divided alumina, and the like. A cleaning aid, liquid or dry, can be applied to a cleaning agent as a preparatory step to using the cleaning member sleeve. Thus cleaning agent embodiment labeled 60C is a longitudinally extending brush made of fibers 63, which fibers carry a cleaning aid 64. As another example, cleaning agent embodiment 60D is a longitudinally extending pad 68 adhered to substrate 60 at interface 67, with a cleaning aid 69 carried by the pad 68.

It is to be understood that the exemplary embodiments co-illustrated in FIG. 7*c*, are not limiting, e.g., a brush similar to brush 60C can be alternatively supported by a backing layer, analogous to embodiment 60B. A cleaning agency can be formed from one or more pad strips disposed longitudinally on a tubular substrate. Moreover, combinations of brushes and/or pads can be used, as may be required. Each such pad or brush can be supported by respective backing layer material.

Figure 7D:
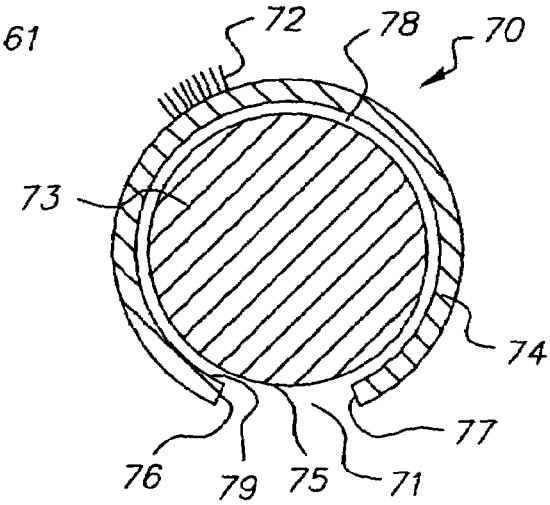
FIG. 7*d* schematically shows, in cross-section, an exemplary cleaning member in the form of a circumferentially incomplete sleeve, the incomplete sleeve curved around a portion of the exterior surface of a roller so as to leave uncovered a longitudinally extending portion, the cleaning member including an exemplary cleaning agency in the form of a longitudinal brush.

FIG. 7*d* schematically shows, in cross-section, an exemplary embodiment 70 of a cleaning member having the form of an incomplete sleeve including a substrate 74, the substrate defining a longitudinally extending opening 71 formed by the edges 76 and 77. The incomplete sleeve is curved around a portion of the exterior surface 75 of a roller 73 so as to leave uncovered a longitudinally extending portion of surface 75, i.e., as defined by the opening 71 running parallel to the axis of rotation of the roller. The material and structural characteristics of substrate 74 are entirely similar to those of tubular substrate 11 of embodiment 10 of FIG. 6*a*. Included in the cleaning member 70 is a cleaning agency for cleaning a cleanable surface, which cleaning agency can for example be a cleaning agent in the form of a brush 72, as shown in FIG. 7*d*. Brush 72 can be formed as a longitudinally extending (relatively narrow) strip of brush in the manner of brush 54 of FIG. 7*b*. Alternatively, a cleaning agent (brush) can cover effectively all of substrate 74. Any other suitable cleaning agency can be used in cleaning member 70, e.g., a different cleaning agent (not illustrated) in lieu of brush 72, which alternative cleaning agent can be mounted on backing layer material (see for example embodiment 60B). Plural cleaning agents, including more than one type of cleaning agent, can be disposed on substrate 74. Furthermore, a cleaning agent disposed on substrate 74 can include a cleaning aid (see for example embodiments 60C and 60D). A gap 78, indicated in FIG. 7*d*, represents a condition that the interior surface 79 of member 70 preferably does not fit on surface 75. Gap 78 is not required to be uniform around roller 73. Moreover, interior surface 79 can touch surface 75 in one or more places, e.g., during manual cleaning of a cleanable surface via (reciprocating) longitudinal motion and/or (reciprocating) rotary motion of sleeve member 70, as described above.

In embodiment 70, a spacing 71 located between ends 76, 77 can have a function, especially during longitudinal cleaning motions. For example, when roller 73 is an imaging cylinder (see FIG. 1) a spacing 71 can be useful if member 70 is mounted and moved in manner so as not to scratch or otherwise disturb the surface of a nearby blanket cylinder (blanket cylinder retracted, or not). Alternatively, spacing 71 can be lined up so that longitudinal cleaning motions of member 70 can bypass a particular member peripherally adjacent roller 73.

EXAMPLE

Cleaning Sleeve for LED Lens Array

An inexpensive cleaning sleeve analogous to embodiment 50 of FIGS. 7*a* and 7*b* was made for cleaning a lens array of a LED writer included in an imaging module of a NexPress 2100 digital color printer (of NexPress Solutions LLC of Rochester, N.Y.). The lens array was mounted adjacent an imaging cylinder as indicated in FIG. 1. The imaging cylinder included a mandrel and a photoconductive sleeve stretchably mounted around the mandrel, with the outer diameter of the sleeve on the mandrel being approximately 181 mm. The cleaning sleeve of this Example was formed by a cardboard tube lined with a smooth acid-free photo paper (similar to a black paper commonly used by Eastman Kodak Company, of Rochester, N.Y., for photographic materials) to which tube was adhered a cleaning agent in the form of a 4 cm wide longitudinal brush strip, the brush having acrylic fibers attached to a backing layer, the backing layer strip glued to the cardboard tube, with fiber lengths about 20 mm. The inner diameter of the photo paper lined cardboard tube was approximately 182 mm. The length of the cleaning sleeve was approximately the same as that of the imaging cylinder (396 mm). The cleaning sleeve was manually mounted around a free end of the imaging cylinder, with the imaging cylinder supported in cantilever fashion at its other end in manner described above in reference to FIG. 3. To clean the lens array, the cleaning sleeve was manually moved, primarily with reciprocating longitudinal movement(s), so that the brush strip rubbed the lens array of the LED writer. No cleaning aid, such as a cleaning chemical or abrasive, was applied to the brush. The cleaning sleeve of the Example performed satisfactorily for cleaning the LED lenses, and the smooth acid-free photo paper did not scratch or otherwise damage the surface of the imaging cylinder. The above-described cleaning sleeve is inexpensive enough so as to be a disposable item. However, the brush of the sleeve can itself be cleaned (elsewhere) and the sleeve reused if desired. The particular type of cleaning sleeve described has an additional advantage in that it can have an additional use as a packaging material, e.g., when shipping a pre-assembled mandrel-plus-photoconductor sleeve, the cleaning sleeve can be mounted as a protective covering for a delicate photoconductor surface.

Notwithstanding common usage of LED writers in electrophotographic machines, in certain machines a laser beam writer can be used instead of a LED writer. Thus in lieu of LED writer 120 in FIG. 2, a laser beam writer including a rotating polygon could be used to raster a laser beam across the surface (parallel to the rotational axis) of a rotating roller 105 (laser beam writer and polygon not illustrated). A cleaning member of the invention, which includes a suitable cleaning agency such as a brush or a pad, can be employed to periodically clean contaminated reflecting surfaces of a polygon, e.g., by using longitudinal movement(s) of the cleaning member. The subject invention provides a way for cleaning a polygon, which is advantageous, in that the polygon is not required to stop at a precise position, which is a feature of the Koguchi patent (U.S. Pat. No. 6,327,067).

A method is described for periodic cleaning of cleanable surface, the cleanable surface included in at least one electrophotographic process device disposed in proximity to an exterior surface of a roller included in an electrophotographic machine, the roller having a longitudinal axis, the roller operationally including a disconnectable removable support member at one end, the periodic cleaning utilizing a cleaning sleeve temporarily mountable around at least a portion of the exterior surface of the roller, the cleaning sleeve including a tubular substrate supporting a cleaning agency, the cleaning agency for cleaning the cleanable surface, the method including the steps of:

with the electrophotographic machine not running, disconnecting and removing the disconnectable removable support member so as to produce a free end of the roller supported in cantilever fashion, the other end of the roller remaining supported in situ in the electrophotographic machine;

installing the cleaning sleeve by moving the cleaning sleeve over and around the free end so as to cover at least a portion of the exterior surface of the roller;

providing a motion of the cleaning sleeve so as to cause the cleaning agency to act on the cleanable surface, the motion including a longitudinal movement and/or a rotary movement about the longitudinal axis;

removing the cleaning sleeve from the roller; and reconnecting the disconnectable removable support member.

In the above method it is preferred that the cleaning agency includes at least one cleaning agent selected from the following categories of cleaning agent: brush, pad, woven material, fabric, cloth, rubber, sponge, and foam. Also, in relation to the above method, cleanable surface can include: a lens surface incorporated in a lens array of a LED writer, an exterior surface of a grid of a gridded corona charger, a surface of a corona wire of a non-gridded corona charger, a surface of a cleaning blade included in a cleaning station, a surface of a doctor blade, an exterior surface of an erase lamp, a surface of a developer pickup (DPU) scavenger device, an exterior surface of a sensor included in a densitometer or electrometer, or a retractable surface of a rotatable process device adjacent the roller.

The invention has been described in detail with particular reference to certain preferred embodiments thereof, but it will be understood that variations and modifications can be effected within the spirit and scope of the invention.

What is claimed is:

1. A cleaning member, removably mountable on a support having a longitudinal axis, said support included in an electrophotographic machine, at least one electrophotographic process device adjacent said support, said cleaning member adapted to periodically clean a cleanable surface of said at least one electrophotographic process device, said cleaning member comprising:

a substrate selectively receivable on said support, said support being a roller of an imaging cylinder for an electrophotographic process device;

a cleaning agency supported on said substrate; and said substrate being substantially tubular to mate with said roller, and when on said support, being movable relative to said longitudinal axis with motion so that said cleaning agency operatively contacts said cleanable surface to clean said cleanable surface.

2. Cleaning member of claim 1, wherein at least one electrophotographic process device is selected from the group of electrophotographic process devices including: a LED writer, a primary corona charger, a pre-clean corona charger, a cleaning mechanism included in a cleaning station for cleaning said imaging cylinder, a developer pickup (DPU) scavenger device, a sensor included in a densitometer for measuring toner lay down on said imaging cylinder, and electrometer, and a pre-erase lamp for use in regenerating said imaging cylinder; and wherein said cleanable surface is included in said selected at least one electrophotographic process device.

3. Cleaning member of claim 1, wherein said cleanable surface includes at least one of: a lens surface included in an array of lenses incorporated in a LED writer, an exterior surface of a grid of a gridded corona charger, a surface of a corona wire of a non-gridded corona charger, a surface of a cleaning blade included in a cleaning station, an exterior surface of an erase lamp, a surface of a developer pickup (DPU) scavenger device, an exterior surface of a sensor included in a densitometer or electrometer, or a surface of a rotatable process device retractably adjacent said roller.

4. Cleaning member of claim 1, wherein said cleaning agency comprises at least one cleaning agent selected from the following groups of cleaning agent: brush, pad, woven material, fabric, cloth, rubber, sponge, and foam.

5. Cleaning member of claim 4, wherein said cleaning agency includes a backing layer material, mounted in non-slip fashion, on said tubular substrate.

6. Cleaning member of claim 4, wherein said cleaning agency includes a brush formed by a plurality of fibers, said plurality of fibers including fibers made of a polymeric material, said polymeric material including an acrylic material, said plurality of fibers including the following types of fibers: bristles, hairs, or filaments.

7. Cleaning member of claim 6, wherein said plurality of fibers have lengths in a range of approximately between 3 mm-30 mm.

8. Cleaning member of claim 4, wherein said at least one cleaning agent carries a cleaning aid, said cleaning aid comprising at least one of: liquid or particulates.

9. Cleaning member of claim 1, wherein said cleaning agency comprises at least one strip of a cleaning agent running longitudinally on said substrate in a manner such that each of said at least one strip is adjacent a strip on said substrate that is free of any cleaning agent.

10. Cleaning member of claim 1, wherein, with said tubular substrate installed around at least a portion of the exterior surface of said roller, said tubular substrate has an inner circumference at least as great as an outer circumference of said exterior surface of said roller, such that any difference between said inner circumference of said tubular substrate and said outer circumference of said exterior surface is a pre-selected difference.

11. Cleaning member of claim 10, wherein said pre-selected difference is greater than about 1 mm.

12. Cleaning member of claim 10, wherein:

motion of said cleaning member includes a longitudinal movement and/or a rotary movement about said longitudinal axis.

13. Cleaning member of claim 12, wherein said roller remains stationary during said motion.

14. Cleaning member of claim 1, wherein said tubular substrate comprises at least one of the following materials: paper, cardboard, plastic, synthetic polymer, rubber, filaments, fabric, or metal.

15. Cleaning member of claim 1, wherein, with said cleaning member in said electrophotographic machine, said tubular substrate grippingly surrounds the exterior surface of said support roller with a predetermined interference, and a rotary motion is imparted by a rotation of said support roller about said longitudinal axis.

16. Cleaning member of claim 15, wherein said exterior surface of said roller is formed by removal of at least one sleeve member from a mandrel included in said roller, said at least one sleeve member operationally included in said roller.

* * * * *